US007666353B2

(12) United States Patent
Donahue et al.

(10) Patent No.: US 7,666,353 B2
(45) **Date of Patent: *Feb. 23, 2010**

(54) ALUMINUM-SILICON ALLOY HAVING REDUCED MICROPOROSITY

(75) Inventors: Raymond J. Donahue, Fond du Lac, WI (US); Terrance M. Cleary, Fond du Lac, WI (US); Kevin R. Anderson, Fond du Lac, WI (US)

(73) Assignee: Brunswick Corp, Lake Forest, IL (US)

( * ) Notice: Subject to any disclaimer, the term of this patent is extended or adjusted under 35 U.S.C. 154(b) by 408 days.

This patent is subject to a terminal disclaimer.

(21) Appl. No.: 11/042,252

(22) Filed: Jan. 25, 2005

(65) Prior Publication Data

US 2005/0163647 A1 Jul. 28, 2005

Related U.S. Application Data

(63) Continuation-in-part of application No. 10/429,098, filed on May 2, 2003, now Pat. No. 6,923,935.

(51) Int. Cl.
*C22C 21/04* (2006.01)

(52) U.S. Cl. ..... 420/548; 420/549

(58) Field of Classification Search ..... 420/548, 420/549

See application file for complete search history.

(56) References Cited

U.S. PATENT DOCUMENTS 4,969,428 A 11/1990 Donahue et al.

(Continued)

FOREIGN PATENT DOCUMENTS

EP 0 813 922 12/1997

(Continued)

OTHER PUBLICATIONS

"Aluminum and Aluminum Alloys", ASM International, 1993, p. 88-101.*

(Continued)

*Primary Examiner*—Roy King
*Assistant Examiner*—Janelle Morillo
(74) *Attorney, Agent, or Firm*—Andrus, Sceales, Starke & Sawall, LLP

(57) ABSTRACT

An aluminum silicon die cast alloy having a very low iron content and relatively high strontium content that prevents soldering to dies into die casting process. The alloys of the present invention also have a modified eutectic silicon and modified iron morphology, when iron is present, resulting in low microporosity and high impact properties. The alloy comprises 6-22% by weight silicon, 0.05 to 0.20% by weight strontium and the balance aluminum. Preferably, the alloy of the present invention contains in weight percent: 6-20% silicon, 0.05-0.10% strontium, 0.40% maximum iron and most preferably 0.20% maximum iron, 4.5% maximum copper, 0.50% maximum manganese, 0.60% maximum magnesium, 3.0% maximum zinc, balance aluminum. On cooling from the solution temperature, the strontium serves to modify the eutectic silicon structure as well as create an iron phase morphology change if iron is present, facilitating feeding through the aluminum interdendritic matrix. This, in turn, creates a finished die cast product with extremely low levels of microporosity defects. The strontium content also appears to create a non-wetting monolayer of strontium atoms on the surface of a molten casting, preventing die soldering, even at very low iron contents. The alloy may be used to cast any type of object and is particularly suited for casting outboard marine propellers, driveshaft housings, gear case housings, Gimbel rings and engine blocks.

16 Claims, 5 Drawing Sheets

U.S. PATENT DOCUMENTS

| | | | | |
|---|---|---|---|---|
| 5,009,844 | A | 4/1991 | Laxmanan | |
| 5,023,051 | A | 6/1991 | Lindburg | |
| 5,045,110 | A * | 9/1991 | Vader et al. | 75/338 |
| 5,234,514 | A | 8/1993 | Donahue et al. | |
| 6,139,654 | A | 10/2000 | Boone et al. | |
| 6,221,504 | B1 | 4/2001 | Pfeffinger et al. | |
| 6,267,829 | B1 | 7/2001 | Backerud et al. | |
| 6,355,213 | B1 | 3/2002 | Takasaki et al. | |
| 6,364,970 | B1 | 4/2002 | Hielscher et al. | |
| 6,402,860 | B2 | 6/2002 | Hashikura et al. | |
| 6,773,666 | B2 * | 8/2004 | Lin et al. | 420/546 |
| 6,923,935 | B1 | 8/2005 | Donahue et al. | |

FOREIGN PATENT DOCUMENTS

| | | |
|---|---|---|
| WO | WO-89/07662 | 8/1989 |
| WO | WO-96/27686 | 9/1996 |

OTHER PUBLICATIONS

"Huttenaluminium-Gusslegierungen", Aluminium Rheinfelden GmbH, Edition Nov. 1994.

*Typical and Minimum Mechanical Properties of Aluminum Alloy Castings*, J. Gilbert Kaufman et al., Aluminum Alloy Castings—Properties, Processes, and Applications, AFS and ASM International, Copyright 2004, p. 71.

*Selection and Application of Aluminum Alloys*, ASM Specialty Handbook, Aluminum and Aluminum Alloys, J. R. Davis, Copyright 1993, pp. 89-91, 110, 113-114.

*The Treatment of Liquid Aluminum-Silicon Alloys*, The American Foundrymen's Society, Inc., John E. Gruzleski, Copyright 1990, pp. 36, 38, 45, 48-49, 54, 80, 180, 184.

*Solidification of Castings*, Foundry Engineering, Department of Metallurgy Massachusetts Institute of Technology, Howard F. Taylor et al., Copyright 1959, pp. 119, 121.

*Factors to Consider About Diecasting*, Aluminum Casting Technology, 2nd Edition, John L. Jorstad et al., Copyright 1993, p. 13.

*Production Techniques 2—Shell, Investment and Die Casting*, Foundry Technology, P. R. Beeley, Copyright 1972, p. 480.

*Casting and Aluminum and Its Alloys*, The Aluminum Industry in Two Volumes, Chemical Engineering Series, Junius Davie Edwards, Copyright 1930, p. 331.

*Assessment of the Influence of Slow to Fast Shot Transition Point on Cavity Filling Patterns in Cold Chamber Die Casting*, Nadca Technical Guidebook Project Summary, J. Brevick, Aug. 30, 2000, 4 pgs., www.diecasting.org.

*Strontium as a modifying agent for Al-Si eutectic alloy*, P. Davami et al., British Foundryman, vol. 72, No. 4, 1979, pp. 4-7.

*Effect of variation of Aluminum-alloy chemistry (titanium and strontium additions) on die/molten metal interface interactions*, Proceedings of the 5th International Molten Metal Conference, 1998, pp. 211-230, XP009064953.

*The influence of strontium on porosity formation in Al-Si alloys*, Metallurgical and Materials Transactions A, vol. 35A, 2004, pp. 3531-3541, XP00906493.

*Mechanism and preventive measures for die soldering during AI casting in a ferrous mold*, JOM, Minerals metals & materials Society, Warrendale, PA, US, vol. 54, No. 8, Aug. 2002, pp. 47-54, XP001246601.

*Aluminum and aluminum alloys*, 1993, ASM International, Materials Park, OH, pp. 97-99, XP002376502.

"Aluminum and Aluminum Alloys" ASM Specialty Handbook, Copyright 1993.

"Solidification Characteristics of Aluminum Alloys," vol. 2, Foundry Alloys, Copyright 1990.

"Aluminum Properties and Physical Metallurgy," American Society for Metals, Copyright 1984.

"Advanced Casting Research Center, Consortium Meeting, May 25, 2004," Report 04-#1, Metal Processing Institute.

"Aluminum Handbook," vol. 1: Fundamentals and Materials, First Edition, Aluminum-Verlag Marketing & Kommunikation GmbH, 1999.

"The Physical Properties of Liquid Metals," Takamichi Iida & Roderick I.L. Guthrie, Clarendon Press-Oxford 1988.

Olsen, D.A. and Johnson, D.C. (1963), J. Phys. Chem. 67, 2529.

* cited by examiner

| | |
|---|---|
| $\mu 1=5.2648$, $\sigma 1=0.1453$<br>$\mu 2=5.9581$, $\sigma 2=0.0884$<br>$\mu 3=5.9546$, $\sigma 3=0.0851$ | IMPACT STRENGTH OF V6 /ALPHA PROPELLERS |

| ALLOY - TEMPERATURE (°F) |
|---|
| 514 - 1320<br>L2 MLE - SRM MED<br>F=9 /S=0 |
| ALLOY OF THE PRESENT INVENTION - 1260<br>L2 MLE - SRM MED<br>F=12 /S=0 |
| ALLOY OF THE PRESENT INVENTION - 1320<br>L2 MLE - SRM MED<br>F=9 /S=0 |
| CB[FM]@90.00%<br>2-SIDED-B[T1] |

| | |
|---|---|
| $\mu 1=5.0478$, $\sigma 1=0.0984$<br>$\mu 2=5.3055$, $\sigma 2=0.0966$<br>$\mu 3=5.1217$, $\sigma 3=0.1229$ | IMPACT STRENGTH COMPARISON OF AA514 v. SILAFONT 36 v. ALLOY OF THE PRESENT INVENTION |

| ALLOY - TEMPERATURE |
|---|
| 514 - 1320<br>L2 MLE - SRM ME<br>F=23 /S=0 |
| ALLOY OF THE PRESENT INVENTION - 1260<br>L2 MLE - RRM MED<br>F=33 /S=0 |
| SILAFONT 36 - 1260<br>L2 MLE - SRM MED<br>F=26 /S=0 |
| CB[FM]@90.00%<br>2-SIDED-B[T1] |

ALUMINUM-SILICON ALLOY HAVING REDUCED MICROPOROSITY

CROSS REFERENCE TO RELATED APPLICATIONS

The present application is a continuation-in-part of U.S. application Ser. No. 10/429,098, filed May 2, 2003 now U.S. Pat. No. 6,923,935.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Aluminum silicon (AlSi) alloys are well known in the casting industry. Metallurgists are constantly searching for AlSi alloys having high strength and high ductility and that can be used to cast various parts at a relatively low cost. Herein is described an AlSi alloy with low microporosity, high strength and ductility, and when used for die casting, does not solder to die casting dies.

Most AlSi die casting alloys contain magnesium (Mg) to increase the strength of the alloy. However, the addition of Mg also decreases the ductility of the alloy. Further, during the die casting solidification process, Mg-containing AlSi alloys experience a surface film that forms on the outer surface of the molten cast object.

Since most aluminum alloys contain some Mg (generally less than 1% by weight), it is expected that the surface film that forms is $MgO—Al_2O_3$, known as "spinel". During the beginning of the solidification process, the spinel initially protects the molten cast object from soldering with the die casting die. However, as the molten cast object continues to solidify, the moving molten metal stretches and breaks the spinel, exposing fresh aluminum that solders with the metal die. Basically, the iron (Fe) in the dies thermodynamically desires to dissolve into the iron-free aluminum. To decrease this thermodynamic driving force, the iron content of the aluminum alloy traditionally is increased. Thus, if the aluminum alloy already contains the iron it desires (with traditionally, a 1% by weight Fe addition), the aluminum alloy does not have the same desire to dissolve the iron atoms in the dies. Therefore, to prevent die soldering, AlSi alloys, and even Mg-containing AlSi alloys, traditionally contain iron to prevent soldering of the alloy to the die casting molds. Significantly, in the microstructure of such alloys, the iron occurs as elongated needle-like phase, the presence of which has been found to decrease the strength and ductility of AlSi alloys and increase microporosity.

The solidification range, which is a temperature range over which an alloy will solidify, is the range between the liquidus temperature and the invariant eutectic temperature. The wider or greater the solidification range, the longer it will take an alloy to solidify at a given rate of cooling. During a hypoeutectic (i.e. containing <11.6% by weight Si) AlSi alloy's descent through the solidification range, aluminum dendrites are the first to form. As time elapses and the cooling process proceeds, the aluminum dendrites grow larger, eventually touch, and form a dendritic network. During this time frame, and sometimes even before the precipitation of the primary aluminum phase, the elongated iron needle-like phase also forms and tends to clog the narrow passageways of the aluminum dendritic network, restricting the flow of eutectic liquid. Such phenomena tends to increase the instance of microporosity in the final cast structure.

A high degree of microporosity is undesirable, particularly when the alloy is used for engine blocks, because high microporosity causes leakage under O-ring seals on machined head deck surfaces, and lowers the torque carrying capacity of machined threads. Further, hypoeutectic AlSi alloy engine blocks are designed to have electro-deposited material, such as chromium, on the cylinder bore surfaces for wear resistance. Microporosity prevents the adhesion of the electro-deposited chrome plating.

Similarly, AlSi alloys cast using a high pressure die casting method also result in a porous surface structure due to microporosity in the parent bore material that, if used in engine parts, is particularly detrimental because it contributes to high oil consumption. Conventionally, hypereutectic (i.e. containing >11.6% by weight Si) AlSi alloys have been used to produce engine blocks for outboard and stern drive motors in the recreation boating industry. Such alloys are advantageous for use in engine blocks as they provide a high tensile strength, high modulus, low coefficient of thermal expansion, and are resistant to wear.

Furthermore, microporosity in mechanical parts is detrimental because the microporosity decreases the overall ductility of the alloy. Microporosity has been found to decrease the ductility of a AlSi cast object, regardless of whether the object is cast from a hypoeutectic, hypereutectic, eutectic or modified eutectic AlSi alloy.

Nearly 70% of all cast aluminum products made in the United States are cast using the die casting process. As forementioned, conventional AlSi alloys contain approximately 1% by weight iron to avoid die soldering. However, the iron addition degrades mechanical properties, particularly the ductility of the alloy, and to a greater extent than any of the commercial alloying elements used with aluminum. As a result, die cast alloys are generally not recommended in an application where an alloy having high mechanical properties is required. Such applications that cannot traditionally be satisfied by the die casting process may be satisfied with much more expensive processes including the permanent mold casting process and the sand casting process. Accordingly, all AlSi die casting alloys registered with the Aluminum Association contain 1.2 to 2.0% iron by weight, including the Aluminum Association designations of: 343, 360, A360, 364, 369, 380, A380, B380, 383, 384, A384, 385, 413, A413, and C443.

Furthermore, experimentation has demonstrated that the tensile strength, percent elongation, and quality index of AlSi alloys decreases as the amount of iron increases. For example, an AlSi alloy having 10.8% by weight silicon and 0.29% by weight iron has a tensile strength of approximately 31,100 psi, a percent elongation of 14.0, and a quality index (i.e. static toughness) of 386 MPa. In contrast, an AlSi alloy having 10.1% by weight silicon and 1.13% by weight iron has a tensile strength of 24,500 psi, a percent elongation of 2.5, and a quality index of 229 MPa. In further contrast, an AlSi alloy having 10.2% by weight silicon and 2.08% by weight iron has a tensile strength of 11,200 psi, a percent elongation of 1.0, and a quality index of 77 MPa.

Therefore, it would be advantageous to reduce the iron content of die casting AlSi alloys so that the iron needle-like phases are reduced to facilitate interdendritic feeding and correspondingly reduce microporosity. However, it is also important to prevent die cast AlSi articles from soldering to die cast molds, a problem that is traditionally solved by adding iron to the alloy.

Additionally, AlSi alloys, and particularly hypoeutectic AlSi alloys, generally have poor ductility because of the large irregular shape of the acicular eutectic silicon phase, and because of the presence of the beta-(Fe, Al, Si) type needle-like phase. The aforementioned iron needles and acicular eutectic silicon clog the interdendritic passageway between the primary aluminum dendrites and hinder feeding late in the solidification event resulting in microporosity (as aforementioned) and also decrease mechanical properties such as ductility. It has been recognized that the growth of the eutectic silicon phase can be modified by the addition of small amounts of sodium (Na) or strontium (Sr), thereby increasing the ductility of the hypoeutectic AlSi alloy. Such modification further reduces microporosity as the smaller eutectic silicon phase structure facilitates interdendritic feeding.

U.S. Pat. No. 5,234,514 relates to a hypereutectic AlSi alloy having refined primary silicon and a modified eutectic. The '514 patent is directed to modifying the primary silicon phase and the silicon phase of the eutectic through the addition of phosphorus (P) and a grain refining substance. When this alloy is cooled from solid solution to a temperature beneath the liquidus temperature, the phosphorus acts in a conventional manner to precipitate aluminum phosphide particles, which serve as an active nucleant for primary silicon, thus producing smaller refined primary silicon particles having a size generally less than 30 microns. However, the '514 patent indicates that the same process could not be used with a hypereutectic AlSi alloy modified with P and Na or Sr, because the Na and Sr neutralize the phosphorous effect, and the iron content of the alloy still causes precipitation of the iron phase that hinders interdendritic feeding.

U.S. Pat. No. 6,267,829 is directed to a method of reducing the formation of primary platelet-shaped beta-phase in iron containing AlSi alloys, in particular Al—Si—Mn—Fe alloys. The '829 patent does not contemplate rapid cooling of the alloy and, thus, does not contemplate die casting of the alloy presented therein. The '829 patent requires the inclusion of either titanium (Ti) or zirconium (Zr) or barium (Ba) for grain refinement and either Sr, Na, or Barium (Ba) for eutectic silicon modification. The gist of the '829 patent is that the primary platelet-shaped beta-phase is suppressed by the formation of an $Al_8$ $Fe_2$ Si-type phase. Formation of the $Al_8$ $Fe_2$ Si-type phase requires the addition of Boron (B) to the melt because the $Al_8Fe_2Si$-type phase favors nucleation on mixed borides. Thus Ti or Zr and Sr, Na or Ba and B are essential elements to the '829 patent teachings, while Fe is an element continually present in all formulations in at least 0.4% by weight.

U.S. Pat. No. 6,364,970 is directed to a hypoeutectic aluminum-silicon alloy. The alloy according to the '970 patent contains an iron content of up to 0.15% by weight and a strontium refinement of 30 to 300 ppm (0.003 to 0.03% by weight). One of skill in the art understands that for this minimum amount of strontium to modify the eutectic silicon, it is absolutely imperative that phosphorus (P), which reacts with Sr and neutralizes it, must be present by less than 0.01% by weight. The hypoeutectic alloy of the '970 patent has a high fracture strength resulting from the refined eutectic silicon phase and resulting from the addition of Sr to the alloy. The alloy further contains 0.5 to 0.8% by weight manganese (Mn). Those of skill in the art will understand Mn is added to modify the iron phase to a "Chinese script" microstructure, and to prevent die soldering. The alloy disclosed in the '970 patent is known in the industry as Silafont 36. The Aluminum Handbook, Volume 1: Fundamentals and Materials. published by Aluminium-Verlag Marketing, & Kommunikation GmbH, 1999 at pp. 131 and 132 discusses the advantages and limitations of Silafont 36 and similar alloys: ". . . ductility cannot be achieved with conventional casting alloys because of high residual Fe content. Thus new alloys such as $AlMg_5Si_2Mn$ (Magsimal-59) and AlSigMgMnSr (Silafont 36) have been developed in which the Fe content is reduced to about 0.15%. In order to ensure there is no sticking [i.e. soldering], the Mn content has been increased to 0.5 to 0.8%, and this has the added, highly desirable effect of improving hot strength."

During use, outboard marine propellers sometimes collide with underwater objects that damage the propellers. If the alloy that form the propeller has low ductility, a propeller blade may fracture off if it collides with an underwater object of substantial size. High pressure die cast hypoeutectic AlSi alloys have seen limited use for marine propellers because they are brittle and lack ductility. Due to greater ductility, aluminum magnesium alloys are in general used for marine propellers. Aluminum magnesium alloys, such as AA 514, are advantageous as they provide high ductility and toughness. However, the repairability of such aluminum magnesium propellers is limited. The addition of magnesium to AlSi alloys has been found to increase the strength of propellers while decreasing the ductility. Thus, AlSi alloys containing magnesium are less desirable than the traditional aluminum magnesium alloys for propellers. Still, it has been found that aluminum magnesium alloys are significantly more expensive to die cast into propellers because the casting temperature is significantly higher and because the scrap rate is much greater.

For cost and geometrical tolerance reasons, propellers for outboard and stern drive motors are traditionally cast using high pressure die cast processes. Propellers may also be cast using a more expensive semi-solid metal (SSM) casting process. In the SSM process, an alloy is injected into a die at a suitable temperature in the semi-solid state, much the same way as in high pressure die casting. However, the viscosity is higher and the injection speed is much lower than in conventional pressure die casting, resulting in little or no turbulence during die filling. The reduction in turbulence creates a corresponding reduction in microporosity. Thus, it would be advantageous to be able to die cast, and particularly high-pressure die cast marine propellers.

Regardless of how marine propellers are cast, the propellers regularly fracture large segments of the propeller blades when they collide with underwater objects during operation. This is due to the brittleness of traditional propeller alloys, as discussed, above. As a result, the damaged propeller blades cannot be easily repaired as the missing segments are lost at the bottom of the body of water where the propeller was operated. Furthermore, the brittleness inherent in traditional die cast AlSi alloys prevents efficient restructuring of the propellers through hammering. Thus, it is desirable to provide a propeller that only bends, but does not break upon impact with an underwater object.

An outboard assembly consists of (from top to bottom, vertically) an engine, a drive shaft housing, a lower unit also called the gear case housing, and a horizontal propeller shaft, on which a propeller is mounted. This outboard assembly is attached to a boat transom of a boat by means of a swivel bracket. When the boat is traveling at high speeds, a safety concern is present if the lower unit collides with an underwater object. In this case, the swivel bracket and/or drive shaft housing may fail and allow the outboard assembly with its spinning propeller to enter the boat and cause serious injury to the boat's operator. Thus, it is a common safety requirement in the industry that an outboard assembly must pass two consecutive collisions with an underwater object at 40 mph and still be operational. Further, as the outboard assembly becomes more massive, this requirement becomes more difficult to meet. As a result, it is generally accepted that outboards having more than 225 HP have problems meeting industry requirements particularly if the drive shaft housings are die cast because of the low ductility and impact strengths associated with conventional die cast AlSi alloys. Accordingly, it would be highly advantageous to be able to die cast drive shaft housings with sufficient impact strength so that the drive shaft housings could be produced at a lower cost. Similarly, it would be advantageous to manufacture gear case housings and stern drive Gimbel rings for these same reasons.

SUMMARY OF THE INVENTION

The present invention is directed to a die casting hypoeutectic and/or hypereutectic AlSi alloy preferably containing by weight 6 to 20% silicon, 0.05 to 0.10% strontium, 0.40% maximum iron and preferably less than 0.20% maximum iron, 4.5% maximum copper, 0.50% maximum manganese, 0.6% maximum magnesium, 3.0% maximum zinc, and the balance aluminum. Most preferably, the alloy of the present invention is free from iron, titanium and boron, however, such elements may exist at trace levels.

Surprisingly, the alloy of the present invention does not solder to die casting dies during the die casting process. This unique alloy because of the die cast cooling rates and strontium content has a eutectic composition that may shift from 11.6% to 14% by weight silicon, and may have a modified, eutectic, hypoeutectic or hypereutectic aluminum-silicon microstructure. The alloy of the present invention is free from primary platelet-shaped beta-$Al_5FeSi$ type phase particles and grain refinement particles such as titanium boride, both of which are detrimental to an alloy's mechanical properties and ductility.

Most preferably, the die casting alloy described above contains 6-20% by weight silicon, 0.05-0.10% by weight strontium, 0.20% by weight maximum iron, 0.05-4.50% by weight copper, 0.05-0.50% by weight manganese, 0.05-0.6% by weight magnesium, 3.0% by weight maximum zinc and the balance aluminum.

An alloy according to the present invention may be utilized to manufacture a multitude of different cast metal objects, including but not limited to, marine propellers, drive shaft housings, Gimbel rings and engine blocks. If the alloy is used to die cast marine propellers, the alloy preferably contains by weight 8.75-9.25% silicon, 0.05-0.07% strontium, 0.3% maximum iron, 0.20% maximum copper, 0.25-0.35% by weight manganese, 0.10-0-20% by weight magnesium and the balance aluminum. If the alloy is used to die cast drive shaft housings, gear case housings or Gimbel rings for outboard motor assemblies, then it is preferred that the magnesium range be modified to 0.35-0.45% by weight magnesium Lower magnesium constituency provides greater ductility necessary for propeller blades, while higher magnesium constituency increases tensile strength and stiffness.

For die casting other types of products, wherein low microporosity and low iron content is desired, but other metallurgical qualities or constituencies need to be taken into account, one of the following preferred compositions may be optimal, depending on the circumstances:

(a) 6.5-12.5% by weight silicon, 0.05-0.07% by weight strontium, preferably 0.35% and most preferably 0.20% by weight maximum iron, 2.0-4.5% by weight copper, 0.50% by weight maximum manganese, 0.30 by weight maximum magnesium, and the balance aluminum;

(b) 6.5-12.5% by weight silicon, 0.05-0.10% by weight strontium, preferably 0.35% and most preferably 0.20% by weight maximum iron, 2.0-4.5% by weight copper, 0.5% by weight maximum manganese, 0.3% by weight maximum magnesium, 3.0% by weight maximum Zinc, and the balance aluminum;

(c) 6.0-11.5% by weight silicon, 0.05-0.10% by weight strontium, preferably 0.35%, and most preferably 0.20% by weight maximum iron, 0.25% by weight maximum copper, 0.50% by weight maximum manganese, 0.60% by weight maximum magnesium, and the balance aluminum.

It will be understood by those of skill in the art that the above formulations apply the newly discovered and surprising realization that AlSi alloys having high strontium content and low iron content have better mechanical properties and do not solder to die casting dies to a wide range of AlSi alloys, including, but not limited to Aluminum Association designations 343, 360, A360, 364, 369, 380, A380, B380, 383, 384, A384, 385, 413, A413 and C443. The iron content is to be below the 0.40% by weight maximum, preferably at a 0.35% by weight maximum, and most preferably under a 0.20% by weight maximum, while the strontium content is to be in the range of 0.05-0.20% by weight, preferably 0.05-0.10% by weight, and most preferably 0.05-0.07% by weight.

Therefore, the present invention contemplates an AlSi die cast alloy comprising 6-22% by weight silicon, 0.05-0.20% by weight strontium and aluminum, where the alloy is substantially free from iron, titanium and boron, such that the alloys does not solder to die cast dies during the die casting process.

An alloy according to the present invention may also be formed with low microporosity and high strength for hypereutectic engine blocks or other engine components. This alloy contains 16-22% by weight silicon, and preferably contains 18-20% by weight silicon such that the alloy comprises a hypereutectic microstructure. The alloy further contains 0.05-0.10% by weight strontium, 0.35% by weight maximum iron, 0.25% by weight maximum copper, 0.30% by weight maximum manganese, 0.60% by weight magnesium, and the balance aluminum. This alloy, with low levels of iron and high amounts of strontium, will have reduced microporosity and increased mechanical properties because the high strontium content and high cooling rate cause the primary silicon to be spherical in shape and the eutectic silicon to be modified. In contrast, if the cooling rate was not as rapid, the primary silicon would be dendritic, and if phosphorous were added, the eutectic silicon would not be modified.

Quite unexpectedly, the very high levels of strontium used in alloys of the present invention have been found to affect the microstructure and increase the interdendritic feeding. It was expected that the addition of the very high levels of strontium would result in modified eutectic silicon through its influence on interdendritic feeding. Also unexpectedly, the addition of the very high levels of strontium causes an iron phase morphology change if iron is present in the alloy. Specifically, the needle-like structures distinctive of traditional iron morphology are reduced to smaller, blocky particles.

The presence of the modified eutectic silicon and the iron phase morphology change have significant effects on interdendritic feeding. Movement of liquid aluminum through the aluminum interdendritic network is facilitated with the smaller eutectic silicon and iron phase particles. This increased interdendritic feeding has been found to significantly reduce the microporosity in cast engine blocks.

Microporosity is undesirable as it causes leakage under O-ring seals on the machined head deck surface of engine blocks, lowers the torque carrying capacity of threads, and severely compromises the ability for plating bores or for parent bore application. Thus, engine blocks with appreciable microporosity are scrapped. The reduction in microporosity results in reduction of scrap blocks which, in turn, results in a more highly economic production of cast engine blocks.

Surprisingly, the alloy of the present invention does not solder to die cast molds, even when there is little or no iron in the alloy constituency. Even with iron lowered to the 0.2% maximum by weight level, the die soldering problem is solved with the addition of very high levels of strontium from 0.05 to 0.20% by weight and preferably at 0.05-0.10% by weight. It is postulated that the high strontium constituent raises the surface tension of the aluminum in the molten alloy during die casting and forms a surface film or monolayer that protects the molten alloy from soldering to the die. The non-wetting monolayer comprises an unstable $Al_4Sr$ lattice with the strontium atoms having a thermodynamic tendency to diffuse away from the surface monolayer.

BRIEF DESCRIPTION OF THE DRAWINGS

The invention is described in relation to some examples and with reference to the accompanying figures in which.

Figure 1:
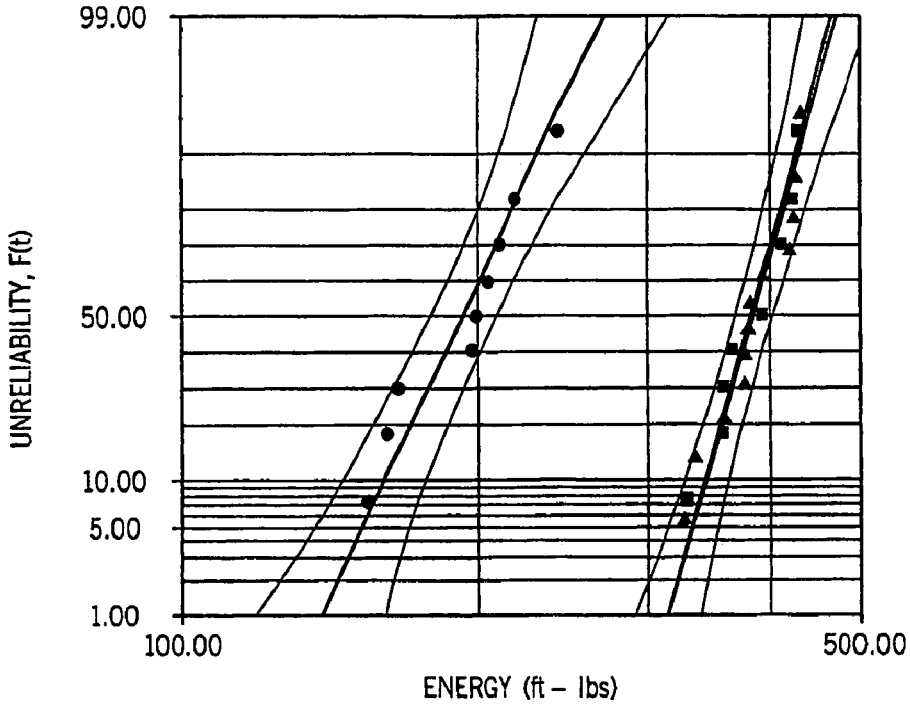
FIG. 1 is a graph demonstrating the comparative impact strength of propellers manufactured from AA 514 and from an alloy according to the present invention.

Various other features, objects, and advantages of the invention will be made apparent from the following detailed description.

DETAILED OF THE PREFERRED EMBODIMENT

A preferred AlSi die cast alloy of the present invention has the following formulation in weight percent:

| Element | Range of Percentages |
|---|---|
| Silicon | 6 to 20% |
| Strontium | 0.05 to 0.10% |
| Iron | 0.40% Maximum |
| Manganese | 0.50% maximum |
| Magnesium | 0.60% maximum |
| Copper | 4.5% maximum |
| Zinc | 3.0% maximum |
| Aluminum | Balance |

Most preferably, an AlSi die cast alloy of the present invention has the following formulation and weight percent:

| Element | Range of Percentages |
|---|---|
| Silicon | 6 to 20% |
| Strontium | 0.05 to 0.10% |
| Iron | 0.20% maximum |
| Copper | 0.05 to 4.5% |
| Manganese | 0.05 to 0.5% maximum |
| Magnesium | 0.05 to 0.6% |
| Zinc | 3.0% maximum |
| Aluminum | Balance |

To die cast a marine propeller according to the present invention, the most preferred AlSi die cast alloy has the following formulation and weight percent:

| Element | Range of Percentages |
|---|---|
| Silicon | 8.75 to 9.75% |
| Strontium | 0.05 to 0.07% |
| Iron | 0.30% maximum |
| Copper | 0.20% maximum |
| Manganese | 0.025 to 0.35% |
| Magnesium | 0.10 to 0.20% |
| Aluminum | Balance |

To die cast a drive shaft housing, gear case housing or Gimbel ring for an outboard motor assembly, the preferred formulation for a die cast AlSi alloy according to the present invention is as follows in weight percent:

| Element | Range of Percentages |
|---|---|
| Silicon | 6.0 to 12.5% |
| Strontium | 0.05 to 0.10% |
| Iron | 0.35% maximum |
| Copper | 4.5% maximum |
| Manganese | 0.50% maximum |
| Magnesium | 0.60% maximum |
| Aluminum | Balance |

The strontium percentages may be narrowed to 0.05 to 0.07% by weight strontium to economically optimize die soldering protection and modify any trace of iron that may be present in the alloy. The copper constituency may be in the range of 2.0 to 4.5% by weight or may be as small as a 0.25% by weight, max., depending on the corrosion protection qualities that the metallurgist intends to impart on the cast product. Finally, the magnesium may be as low as 0.30% by weight maximum as magnesium is not necessary to prevent die soldering, and the low levels of magnesium increases the ductility of the alloy.

An AlSi alloy may be formulated according to the present invention for hypereutectic aluminum-silicon alloy engine blocks, the AlSi alloy having the following formulation and weight percent.

| Element | Range of Percentages |
|---|---|
| Silicon | 16.0 to 22% |
| Strontium | 0.05 to 0.10% |
| Iron | 0.35% maximum |
| Copper | 0.25% maximum |
| Manganese | 0.30% maximum |

-continued

| Element | Range of Percentages |
|---|---|
| Magnesium | 0.60% maximum |
| Aluminum | Balance |

Preferably the alloy contains 18 to 20% by weight silicon and further comprises a hypereutectic microstructure, with round primary silicon particles embedded in a eutectic with a modified eutectic silicon phase. In contrast, die cast hypereutectic AlSi alloys that are phosphorus refined contain polygon-shaped primary silicon particles embedded in a eutectic, wherein the eutectic silicon phase is not modified. Thus, the present invention produces a unique microstructure for hypereutectic alloys.

As one of skill in the art will notice from the formulation set forth above, a wide range of silicon percentages exist for the aluminum alloys in the present invention. It is contemplated that the eutectic composition of an AlSi alloy according to the present invention can shift from 11.6 to 14% by weight silicon because of the rapid die casting cooling rates and because of the high strontium content. Thus, the microstructure of an alloy may be a modified eutectic silicon phase, a eutectic aluminum-silicon microstructure, a hypoeutectic aluminum-silicon microstructure or a hypereutectic aluminum-silicon microstructure.

Further, all AlSi alloys specified above as die cast alloys are not grained refined and are therefore substantially free from any grain refinement elements such as titanium, boron or phosphorus.

As an aluminum alloy according to the present invention is cooled from solution to a temperature below the liquidus temperature, aluminum dendrites begin to appear. As the temperature decreases and solidification proceeds, the dendrites increase in size and begin to form an interdendritic network matrix. Additionally, if iron is present, iron phases form concurrently during solidification or prior to the primary aluminum precipitation.

According to the invention, the high levels of strontium significantly modify the microstructure of the alloy and promote a non-wetting condition to avoid soldering because the strontium increases the surface tension of the aluminum alloy solution. The strontium addition of 0.05 to 0.20%, preferably 0.05% to 0-0.10% and most preferably 0.05 to 0.07% by weight effectively modifies the eutectic silicon and provides monolayer coverage of the molten surface with strontium atoms which effectively produces the non-wetting condition to avoid soldering to die cast dies. In a conventional, unmodified hypoeutectic AlSi alloy, the eutectic silicon particles are large and irregular in shape. Such large eutectic silicon particles precipitate into large acicular shaped silicon crystals in the solidified structure, rendering the alloy brittle. The strontium addition modifies the eutectic silicon phase by effectively reducing the size of the eutectic silicon particles and increases the surface tension of aluminum.

Furthermore, and quite unexpectedly, the strontium addition in the range of 0.05 to 0.20% by weight modifies the iron phase shape morphology if iron is present. Conventionally, the iron phase morphology is needle-like in shape. The strontium addition modifies the iron phase morphology by reducing the iron needles of the microstructure into smaller, blocky particles.

The presence of modified eutectic silicon and the iron phase morphology change has significant effects on interdendritic feeding. The reduction in size of the eutectic silicon particles, along with the reduction in size of the iron phase structures, greatly facilitates liquid metal movement through the interdendritic aluminum network during cooling. As a result, the increased interdendritic feeding has been found to significantly reduce the microporosity in cast engine blocks.

The lowering of the microporosity in the microstructure of the cooled AlSi alloy product greatly reduces the number of blocks that fail to meet porosity specifications. Microporosity is undesirable as it results in leakage of O-ring seals, reduction in the strength of threads, surfaces incapable of metal plating during production, and for parent bore applications, high oil consumption. Thus, engine blocks with substantial microporosity defects are scrapped. With the alloy of the current invention, it is anticipated that a scrap reduction of up to 70% may be obtained solely through the use of this new and novel alloy. The reduction of blocks that fail to meet the porosity specification corresponds to the reduction in amount of blocks scrapped, which in turn, results in a more highly economic production of cast engine blocks.

Additionally, the other elements present in the alloy formulation contribute to the unique physical qualities of the final cast products. Specifically, elimination of grain refining elements prevents detrimental interaction between such elements and the highly reactive strontium.

The AlSi die cast alloys of the present invention also have the unexpected benefit of not soldering to dies during the die casting process, even though the iron content is substantially low. Traditionally, approximately 1% iron by weight was added to AlSi die cast alloys to prevent the thermodynamic tendency of the iron from the die casting dies to dissolve into the molten aluminum. The die castings made with the substantially iron-free alloys of the present invention have dendritic arm spacings smaller than either permanent mold or sand castings and possess mechanical properties superior to products produced in the permanent mold casting or sand casting processes.

During the die casting process, a surface layer oxide film forms on the outer surface of the molten cast object as the alloy is cast and exposed to the ambient environment. When AlSi alloys are die cast, a film of alumina $Al_2O_3$ forms. If the alloy contains Mg, the film is spinel, $MgO—Al_2O_3$. If the alloy contains more than 2% Mg, the film is magnesia MgO. Since most aluminum die cast alloys contain some magnesium, but less than 1%, it is expected that the film on most aluminum alloys is spinel. Such alloys solder to die cast dies because the moving molten metal in a just-cast alloy breaks the film and exposes fresh aluminum to the iron containing die which results in soldering.

Ellingham diagrams, which illustrate that the free energy formation of oxides as a function of temperature, confirm that alkaline earth elements of group IIA (i.e. beryllium, magnesium, calcium, strontium, barium and radium) form oxides so stable that alumina can be reduced back to aluminum and the new oxide takes its place on the surface of the aluminum alloy. Thus, in alloys of the present invention where very low levels of magnesium and iron are present, an aluminum-strontium oxide replaces protective alumina or even spinel film, preventing die soldering.

Additions of alkaline earth elements other than strontium were tested to see if such elements provided the same protection that strontium affords. For example, additions of beryllium, though highly hazardous to health, at levels of 50 ppm by weight caused the protective properties of the film on an aluminum-magnesium alloy melt to improve significantly, with the result being that oxidation losses are reduced. However, even with these improvements of the oxide coating against oxidation losses, beryllium containing die casting alloys experience the soldering problem in the die casting process. Thus, it is expected that high levels of beryllium will not provide the same anti-soldering resistance feature that strontium has demonstrated. The same nonperformance feature is speculated for barium and radium as well. Accordingly, despite the expected similar chemical behavior other members of the IIA group, only strontium-containing die casting alloys appear to exhibit the result of not soldering to die casting dies.

It is contemplated that when AlSi alloys having high strontium concentrations (i.e. 0.05 to 0.20% by weight) and a low iron content, alloy melts will be produced with thicker oxide films on them. Further, the melt side of the oxide films is "wetted" which means that the film will be in perfect atomic contact with the liquid melt. As such, this oxide film will adhere extremely well to the melt, and, therefore, this interface will be an unfavorable nucleation site for volume defects such as shrinkage porosity or gas porosity. In contrast, the outer surface of the oxide film originally in contact with air during the die casting process will continue to have an associated layer of adhering gas. This "dry" side of the oxide film is not likely to know when it is submerged, and therefore, will actively remove traces of any oxygen of any air in contact with it, consequentially causing the strontium oxide to continue to grow. Thus, the gas film will eventually disappear, resulting in contact of the die and strontium oxide coated molten aluminum. Effectively, the driving thermodynamic forces changed for soldering at the die interface and a dynamic oxide barrier coating or monolayer at the interfaces is formed.

Thermodynamically, at infinite dilution, the free energy of formation of any solution from its pure components decreases at an infinite rate with increase in the mole fraction of solute. This is tantamount to stating that there is always a thermodynamic driving force toward some mutual dissolution of pure substances to form a solution. Accordingly, unalloyed aluminum has a strong thermodynamic tendency to take into solution the iron in the steel dies commonly used in the die casting process. This also explains why metallurgists add approximately 1% iron to die cast AlSi alloys, as this addition drastically decreases the aluminum's tendency to want to take into solution more iron from the die. The problem with this solution is that the iron used to avoid die soldering decreases mechanical properties, particularly ductility and impact properties, of the die cast aluminum alloy. This is because the iron, which has a very low solubility in aluminum (approximately 38 ppm) appears in the microstructure with a "needle-like" phase morphology. The needle-like morphology may be modified to "Chinese script" morphology with the addition of manganese. A manganese addition, by modifying the needle-like morphology of the iron phase, helps increase ductility and impact properties, but does not provide the same advantages as if low manganese and slightly higher iron was used in the AlSi die cast alloy, because the modified manganese-iron phases are still "stress risers" in the microstructure. In fact, U.S. Pat. No. 6,267,829 to Backerud et. al points out that the total amount of iron containing inter-metallic particles increases with increasing amounts of manganese added, and further quotes from "The Effects of Iron in Aluminum-Silicon Casting Alloys—A Critical Review" by Paul N. Creapeau (no date) that Creapeau has estimated that 3.3 volume % inter-metallic form for each weight percent total (% Fe+% Mn+Cr) with a corresponding decrease in ductility.

Figure 2:
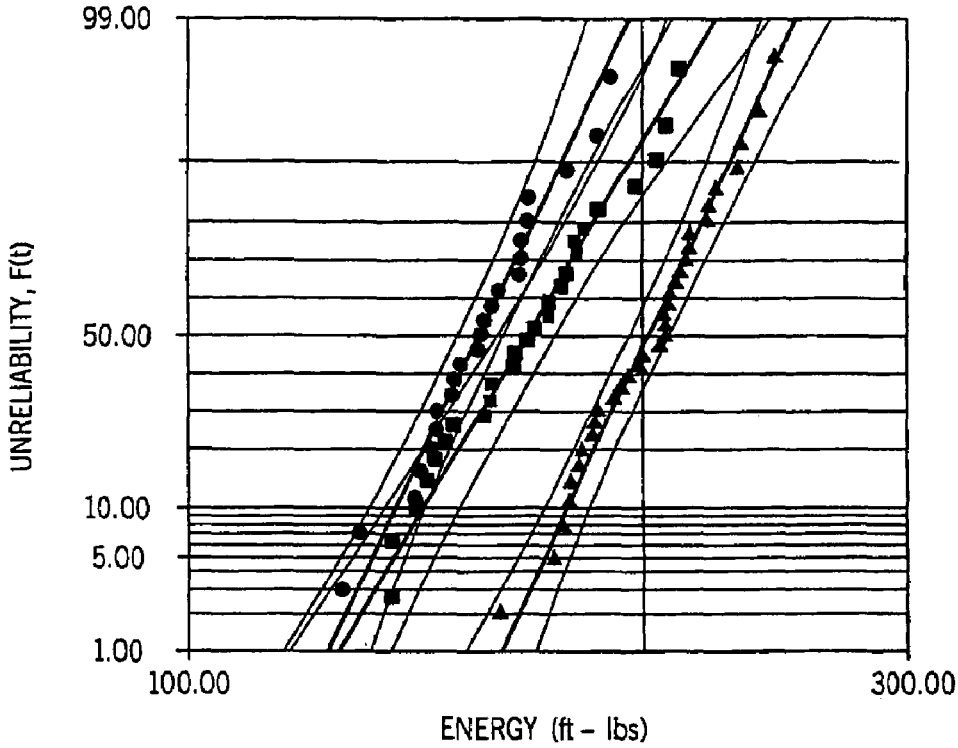
FIG. 2 is a graph demonstrating the comparative impact strength of an alloy according to the present invention relative to AA 514 and Silafont 36.

To illustrate this point, an alloy according to U.S. Pat. No. 6,364,970 (i.e. Silafont 36) was die cast having the following composition: 9.51% by weight silicon, 0.13% by weight magnesium, 0.65% by weight manganese, 0.12% by weight iron, 0.02% by weight copper, 0.04% by weight titanium, 0.023% by weight strontium, balance aluminum. This high manganese AlSi alloy was compared in a drop impact test with an alloy of the present invention with the following chemistry: 9.50% by weight silicon, 0.14% by weight magnesium, 0.28% by weight manganese, 0.20% by weight iron, 0.12% by weight copper, 0.0682% by weight strontium, trace amounts of titanium, and balance aluminum. Both such alloys were further compared with AA 514, as demonstrated in FIG. 2. In spite of the fact that the iron was lower for the alloy composition having high manganese, and in spite of the fact that such alloy had the high manganese content to modify the iron phase morphology, the drop impact properties were not as substantial as the alloy according to the present invention. It was found that the alloy of the present inventions with a 67% higher iron content and a 57% lower manganese content had much higher impact properties. See, FIG. 2. The conclusion is that the higher impact properties are due to the 200% higher strontium content.

It is well known that the surfaces of phases (i.e. liquid phase or solid phase) generally differ in behavior from the bulk of that same phase because rapid structural changes occur at and near phase boundaries. Accordingly, surfaces have a higher amount of energy associated therewith. The excess energy associated with surfaces is minimized by reducing surface area and by reducing surface energy. Since only a small fraction of the overall materials is associated with the surface, only very small amounts of impurities are required to saturate the surface. It has been reported by Sumanth Shankar and Makhlouf M. Makhlouf in WPI Advanced Casting Research Center May 25, 2004 Report No. Pr.04-1 entitled Evolution of the Eutectic Microstructure During Solidification of Hypoeutectic Aluminum Silicon Alloys that 230 ppm strontium increases the solid/liquid surface energy ($\gamma$) from 0.55 N/m to 1.62 N/m at 598 degrees Celsius; from 1.03 N/m to 2.08 N/m at 593 degree Celsius; from 1.39 N/m to 2.59 N/m at 588 degree Celsius; and from 2.24 N/m to 3.06 N/M at 583 degree Celsius. For a constant strontium content, the natural log of these surface energy measurements varies linearly with the natural log of the temperature in degrees Kelvin, as follows:

Modified Al—Si Alloy: in $\gamma=-36.728\ \ln(T)+249.14$; $R^2$ fit parameter=0.9911

Unmodified AlSi Alloy: In $\gamma=-80.042\ \ln(T)+541.48$; $R^2$ fit parameter=0.9928.

Based on these surface energy measurements, it is clear that approximately 200 ppm of strontium can double or triple the solid/liquid surface energy. Thus, the Shankar/Makhlouf findings suggest that 0.05 to 0.10% by weight strontium may increase the surface energy of an alloy by an order of magnitude. Therefore, the surface energy increase associated with a strontium addition favors non-wetting of the molten aluminum and the steel dies. This behavior can be likened or compared to the behavior of droplets of mercury (Hg) versus the behavior of water, the latter which tends to spread out and "wet" a surface.

Since soldering is most likely to occur in the die casting process under conditions that favor wetting, part of the benefit of using high strontium containing AlSi die cast alloys is the non-wetting conditions that are produced by the strontium effect on the solid/liquid surface energy. It is further postulated that the high reactivity of strontium in liquid aluminum solution for oxygen is a factor influencing the low iron or iron free AlSi alloys so that the thermodynamic forces tending to dissolve the iron and soldering with the steel does not develop.

Based on a thermodynamic treatment of interfaces, the Gibbs adsorption equation (i.e. the Gibbs adsorption isotherm) expresses the fact that adsorption or desorption behavior of a solute and liquid metals can be assessed by measuring the surface tension of a metal as a function of solute concentration. According to the Gibbs adsorption equation, the excess surface concentration of a solute in a two-component system at constant temperature and pressure is given by:

$$\Gamma_s = \frac{-d\gamma}{RTd(\ln a_s)}$$

where $\Gamma_s$ is the excess surface concentration of solute per unit area of surface, $\gamma$ is the surface tension, $a_s$ is the activity of solute "s" in the system, R is the gas constant, and T is the absolute temperature in degrees Kelvin. In dilute solutions, the solute activity, $a_s$ can be replaced by the solute's concentration in terms of weight percent. Therefore, at low concentrations of solute, i.e. for strontium in the alloys of the present invention, $\Gamma_s$ to be taken to equal surface concentration of solute per unit interfacial area. As the Gibbs adsorption equation indicates, the excess surface concentration $\Gamma_s$ can be assessed from the slope of the experimentally determined:

$$\frac{d\gamma}{d(\ln a_s)} \text{ curve for } \frac{d\gamma}{d(\ln x)} \text{ values,}$$

where x is the weight percent.

Carefully obtained surface tension measurements made for an unmodified and modified AlSi alloy for four different temperatures by Shankar and Makhlouf determined that strontium additions of 230 ppm raised the isothermal surface tension of aluminum significantly higher for the modified alloy than the unmodified alloy. Further, Shankar's and Makhlouf's $R^2$ goodness of fit parameter for the temperature dependence for the surface tensions was 0.9928 for the unmodified AlSi alloy and was 0.9911 for the modified AlSi alloy, which indicates an excellent fit.

Applying the teachings of Shankar and Makhlouf to the present invention indicates that strontium increases the surface tension of aluminum. A closer inspection of Shankar's and Makhlouf's data demonstrates the following:

| | Temperature (K) | | | |
|---|---|---|---|---|
| | 871 | 866 | 861 | 856 |
| Change in Surface Tension (N/m) (modified minus unmodified) | 1.07 | 1.05 | 1.20 | 0.82 |

Thus, the average change in surface tension is 1.035 N/m with a coefficient of variation of only 15%. Since the unmodified alloy in Shankar's and Makhlouf's investigation had a strontium content two orders of magnitude lower than that of the modified alloy, of approximately 0.00023% by weight, the following is true:

$$\frac{d\gamma}{d\ln(x)} = \frac{1.035}{(\ln 0.0230 - \ln 0.00023)} = \frac{1.035}{4.605} = 0.225 \text{ N/m}$$

Applying this information to the Gibbs adsorption equation where R equals 8.31451 J/K/mole, and where the average temperature equals 863.5 K, the excess concentration of strontium atoms, $$\Gamma_s = \frac{-d\gamma}{RTd\ln(x)} = \frac{0.225}{(8.31451)(863.5)} = 31.3\times10^{-6} \text{ moles/m}^2.$$

Therefore, the area per strontium atoms at the surface is the reciprocal of ($31.3\times10^{-6}$ moles/m$^2$) ($6.02\times10^{23}$ atoms/mole), which is $5.31\times10^{-20}$ m$^2$/atom or 5.31 square Angstroms per atom.

The limiting concentration in a close packed monolayer of strontium atoms (Pauling atoms radius $r=1.13\times10^{-10}$ m for $Sr^{+2}$ ions) is estimated to be $2\sqrt{3}r^2=4.42\times10^{-20}$ m$^2$/atom. This corresponds to $37.54\times10^{-6}$ moles per m$^2$. A comparison with the surface strontium concentration in the monolayer of $31.3\times10^{-6}$ moles per meter squared (as calculated with the Gibbs adsorption isotherm) indicates either an 83.4% coverage, an imperfect monolayer is formed, or the assumption of close packing in the monolayer is incorrect.

Those who are skilled in the art will recognize that the above postulates are suggestions for a strontium concentration of 230 ppm at a pressure of 1 atmosphere. The present invention suggests a strontium concentration of 500-1,000 ppm ensuring full coverage by the surface monolayer. Further, knowing the aluminum-strontium phase diagram, and understating strontium's very limited solubility in aluminum, $Al_4Sr$ tetragonal phase is expected to occur in the microstructure of the alloy. This $Al_4Sr$ tetragonal phase has an a-lattice parameter of 4.31 Angstroms and a c-lattice parameter of 7.05 Angstroms. Thus, the $Al_4Sr$ tetragonal phase is not expected to exhibit a close packed plane in the solid state for any interface. However, the discussion of the surface monolayer and the AlSi alloy of the present invention pertains to the alloy in a liquid state, not a solid state. Also, the application of high pressures are present in die casting on the liquid, incorporating LeChatelier's principle. This principle states that if a system is displaced from equilibrium through the application of a force, that system will move in the direction that will reduce that force. Thus, because rapid structural changes occur in the surface layer compared to the bulk, it is postulated that the die casting pressures are sufficient to cause a liquid monolayer of strontium atoms at the surface of the molten alloy to be close packed.

Figure 3:
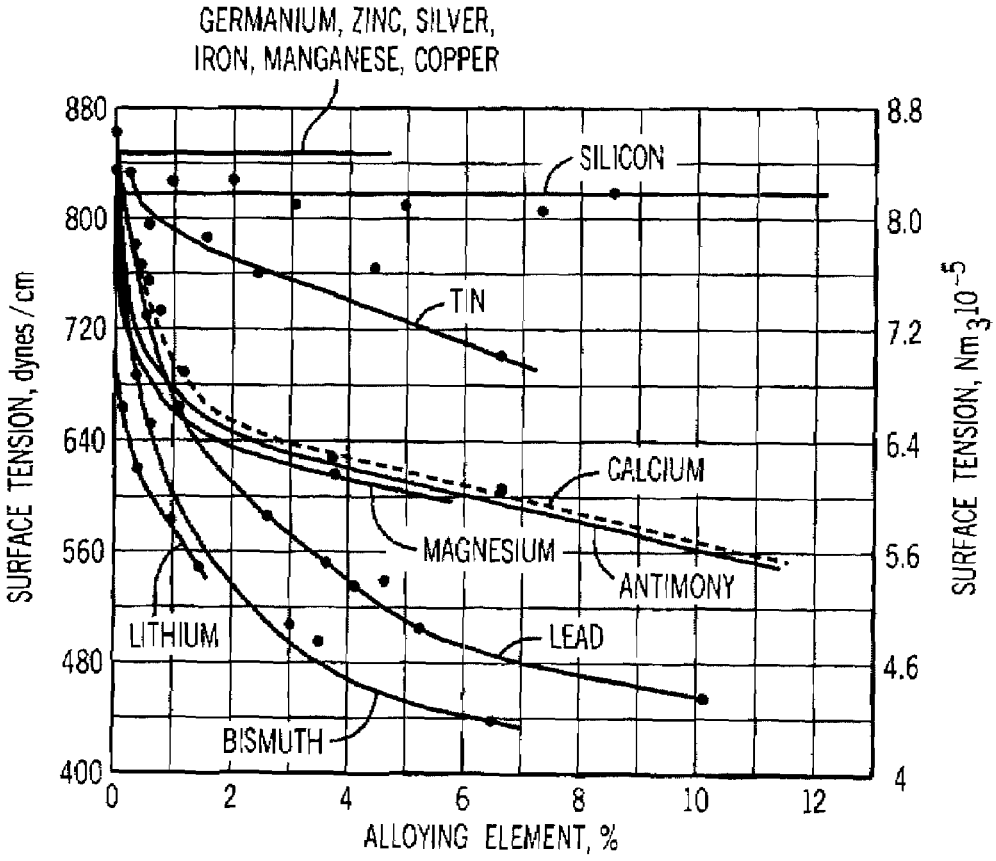
FIG. 3 is a graph from the American Society for Metals demonstrating the effect of added elements on the surface tension of aluminum.

It is appreciated by those with skill in the art that when an element appears to concentrate in a surface layer on aluminum, there is an accompanying reduction in surface tension. This is illustrated in FIG. 3. FIG. 3 is taken from the text entitled Aluminum, Properties and Physical Metallurgy, page 209, published by the American Society for Metals, 1984. FIG. 3 demonstrates that apparently all elements except strontium appear to lower the surface tension of aluminum as they are dissolved in aluminum. Surprisingly, in dilute solutions, even a high-surface tension solute, such as a high-melting point metal, is expected to have little effect on the surface tension of aluminum solutions.

In contrast to this general phenomena, D. A. Olsen and D. C. Johnson, (J. Phys. Chem. 67, 2529, 1963; reported in The Physical properties of Liquid Metals by T. Iida and Roderick I. L. Guthrie, Clarendon Press Oxford, 1988) have studied the surface tension of mercury-thallium amalgams as a function of thallium content and found an increase in surface tension for amalgams with thallium content greater than that of the eutectic composition. The authors explained that if there are components in the melt that form compounds that are less stable in the surface layer than in the bulk, the surface tension of the mixture may be higher than that of the pure components. Thus, the authors conclude that it would appear that a mercury-thallium compound is formed that might be concentrated in the bulk of the amalgam. The formation of such a compound would remove thallium atoms on the surface layers and thereby raise surface tension values.

Using similar reasoning, it is suggested that in the present invention the aluminum-strontium compound, $Al_4Sr$, like the mercury-thallium compound, is unstable in the surface monolayer for thermodynamic reasons, specifically, because the strontium atoms want to diffuse away from the surface monolayer. It is further suggested that to avoid die soldering, a close-packed monolayer of strontium atoms exhibiting nearly 100% coverage because of the preferred 500 to 1,000 ppm strontium content, is in place in a dynamic fashion. It is further postulated that the dynamic characteristic of the surface monolayer occurs partially because of the high pressures of die casting. The close-packed surface monolayer creates non-wetting conditions and make it considerably more difficult for soldering to occur, eliminating the need for iron in alloys of the present invention to prevent die soldering.

When casting engine blocks using the AlSi alloy of the present invention, the alloy demonstrates significant advantages in its physical properties. In the as cast condition, at 0.15% magnesium by weight, yield strength is 17 KSI, ultimate tensile strength is 35 KSI and elongation in 2 inches is 11%. At 0.30% by weight magnesium, yield strength is 18 KSI, ultimate tensile strength is 39 KSI and elongation in 2 inches is at least 9%. At 0.45% magnesium by weight, yield strength is 21 KSI, ultimate tensile strength is 42 KSI and elongation in 2 inches is 6%.

Aging the as cast alloy containing 0.30% magnesium by weight four to eight hours at 340° F. provides a yield strength of at least 28 KSI, an ultimate tensile strength of 45 KSI and an elongation in 2 inches of at least 9%. With this T5 heat treatment condition, no loss of ductility occurs over the as cast condition, and the ultimate tensile strength is increased by 15%, while the yield strength is increased by 50%. With T5 treatment, no solution heat treatment is affected.

The T6 heat treatment condition, aged at 340° F. for four to eight hours, increases the yield strength to 35 KSI, an increase of nearly 100% over the as cast condition, with no loss in ductility over the as cast condition. However, in the T6 heat treatment condition, solution heat treatment is affected, and some blistering may occur during the solution heat treating.

The T7 heat treatment condition, aged at 400° F. for four to eight hours with solution heat treatment, and the T4 heat treatment condition, aged at room temperature for four to eight hours without solution heat treatment, both increase the elongation in 2 inches over 100% compared to the as cast condition while maintaining the equivalent yield strength of the as cast condition.

Hypoeutectic AlSi alloys of the invention can be employed to cast engine blocks for outboard and stern drive marine motors. When such engines are to be cast, the magnesium level of the alloy is 0.0-0.6% by weight and is preferably kept in the range of 0.20-0.50% by weight.

EXAMPLE 1

An alloy was prepared having the following composition in weight percent: 11.1% silicon, 0.61% magnesium, 0.85% iron, 0.09% copper, 0.22% manganese, 0.16% titanium, 0.055% strontium and the balance aluminum. Thirty-six four-cylinder cast engine blocks were then produced from this alloy.

A control lot was prepared using an alloy having the following composition in weight percentage: 11.1% silicon, 0.61% magnesium, 0.85% iron, 0.09% copper, 0.22% manganese, 0.16% titanium and the balance aluminum. Significantly, no strontium was added to this alloy. Thirty-eight four-cylinder blocks were die cast under identical conditions as the blocks of the first alloy using a 1200 ton die casting machine. The only difference between the two sets of blocks is that the first set contained 0.055% by weight strontium and the control lot contained no strontium.

The control lot and the strontium-containing lot were machined and all machined surfaces, threaded holes and dowel pin holes were inspected according to a stringent porosity specification that allowed only two instances of porosity of a size that could extend across two thread spacings for certain M6, M8 and M9 threads.

The thirty-eight control lot blocks produced eight blocks with microporosity defects, a percentage of 21.1%. Of those eight blocks with defects, seven of those blocks failed the porosity specification. Those seven blocks were scrapped, indicating an 18.4% scrap rate for the control lot.

In comparison, the strontium containing lot produced four of thirty-six blocks with defects, a percentage of 11.1%. Of those four blocks, only two were required under the porosity specification to be scrapped. Thus, the scrap rate for the strontium containing lot was 5.6%.

The magnitude of scrap reduction, a reduction of 70% from 18.4% to 5.6% is an unexpected, yet extremely useful result indicating the high strontium level influence in reducing microporosity. This reduction in scrap is essential to a highly economic production of cast engine blocks.

EXAMPLE 2

An alloy was preparing having the following composition in weight percent: 10.9% silicon, 0.63% magnesium, 0.87% iron, 0.08% copper, 0.24% manganese, 0.14% titanium, 0.060% strontium, and the balance aluminum. Forty 2.5 L V-6, two stroke engine blocks were prepared from this alloy.

A control lot was prepared using an alloy having the following composition in weight percentage: 10.9% silicon, 0.63% magnesium, 0.87% iron, 0.08% copper, 0.24% manganese. 0.14% titanium and the balance aluminum. Significantly, no strontium was added to this alloy. Thirty-three 2.5 L V-6, two stroke engine blocks were prepared from this alloy.

Both lots were die cast under identical conditions using a 2500 ton die casting machine, at the same time, and were sequentially numbered. The only difference between the two lots is that the first lot contained 0.060% by weight strontium while the control lot contained no strontium. Both lots were machined together.

The head decks of the engine blocks were examined for microporosity defects. Engine blocks with microporosity defects having a range of 0.010 inches to 0.060 inches in diameter were repaired. Blocks with microporosity defects larger than 0.060 inches in diameter were scrapped. This stringent porosity standard is necessary as an O-ring seal must be placed on the head decks of the engine blocks. Any significant microporosity defects provide opportunity for leakage beneath the O-ring seal.

Thirty-three control lot engine blocks produced sixteen blocks that were scrapped as a result of microporosity defects, a percentage of 48%. In comparison, the lot of forty strontium containing engine locks produced fourteen blocks which were scrapped as a result of microporosity defects, a percentage of 35%.

The magnitude of scrap reduction for this example is 27%, from 48% to 35%. This reduction in scrap due to microporosity defects indicates that the addition of strontium has an extremely useful, while unexpected result. This fundamental effect of lowering microporosity defects is unmistakable and results in a reduction of scrap that is essential to a highly economic production of cast engine blocks.

EXAMPLE 3

An alloy was prepared having the following composition in weight %: 11.3% silicon, 0.63% magnesium, 0.81% iron, 0.10% copper, 0.25% manganese, 0.11% titanium, 0.064% strontium, and the balance aluminum. Thirty-seven 2 L, 4 stroke engine blocks were prepared from this alloy.

A control lot was prepared using an alloy having the following composition in weight percentage: 11.3% silicon, 0.63% magnesium, 0.81% iron, 0.10% copper, 0.25% manganese, 0.11% titanium, and the balance aluminum. Significantly, no strontium was added to this alloy. Twenty-five 2 L, 4 stroke engine blocks were prepared from this alloy.

Both lots were die cast under identical conditions using a different die casting machine than the first two examples. The lots were cast at the same time, and were sequentially numbered. The only difference between the two lots is that the first lot contained 0.064% by weight strontium, while the control lot contained no strontium.

The head decks of the engine blocks were examined for microporosity defects. All machined surfaces, threaded holes and dowel pin holes were inspected. Engine blocks with microporosity defects having a range of 0.010 inches to 0.060 inches in diameter were repaired. Blocks with microporosity defects larger than 0.060 inches in diameter were scrapped.

Twenty-five control lot engine blocks produced twenty blocks with defects, a percentage of 80.0%. Six of the defective blocks were scrapped, resulting in a scrap percentage of 24.0%. In comparison, the lot of thirty-seven strontium containing engine blocks produced twenty-eight blocks with microporosity defects, a percentage of 75.7%. Only five of the thirty-seven blocks had to be scrapped, a scrap percentage of 13.5%.

The magnitude of scrap reduction for this example is 44%, from 24% to 13.5% on a very tough porosity specification. Although 0.010% by weight strontium is more than sufficient to produce the eutectic silicon phase modification noted earlier, this amount of strontium is insufficient to lower the porosity level or the scrap identified above. Therefore, the results identified in the above experiments are unexpected, particularly the magnitude of reduction of the scrapped blocks.

EXAMPLE 4

An AlSi alloy of the present invention may also be used to cast propellers for marine outboard and stern drive motors used in the recreational boating industry. Traditionally aluminum-magnesium alloys are used for die casting propellers, particularly AA 514. When the alloy of the present invention is intended for die casting marine propellers the alloy preferably contains by weight 8.75-9.25% silicon, 0.05-0.07% strontium, 0.3% maximum iron, 0.20% maximum copper, 0.25-0.35% by weight manganese, 0.10-0-20% by weight magnesium and the balance aluminum, providing an alloy that is ductile yet durable for use in the propeller and that does not solder to die casting dies. High ductility is desirable in propellers so that the propeller will bend, but not break, upon impact with an underwater object. As a result, the damaged propeller blades may be more easily repaired. The propellers will not fracture into segments in collisions with underwater objects and may be hammered back into shape.

FIG. 1 exhibits the impact properties of the alloy of the present invention, cast at 1,260 degrees Fahrenheit as compared with impact properties of AA 514 cast at the same temperature. The propellers were cast with an AA 514 alloy having the following specific composition in weight %: 0.6% maximum silicon, 3.5-4.5% magnesium, 0.9% maximum iron, 0.15% maximum copper, 0.4-0.6 manganese, 0.1% maximum zinc, balance aluminum. The alloy of the present invention used to cast propellers had the following composition in weight %: 8.75 to 9.75% silicon, 0.20% maximum iron, 0.05-0.07% strontium, 0.15% maximum copper, 0.25 to 0.35% manganese, 0.10 to 0.20% magnesium, 0.10% maximum zinc, with trace amounts of tin and balance aluminum.

Two lots of V6/Alpha propellers were produced for each alloy, respectfully. The propellers were die cast in 900 ton die casting machines. The AA514 alloy was cast at 1,320 degrees Fahrenheit, while the alloy according to the present invention was cast both at 1,320 degrees Fahrenheit and at 1,260 degrees Fahrenheit. The V-6/Alpha propellers that were produced have a shot weight of approximately 11 pounds. The propellers from each lot were subsequently subjected to a drop impact test to measure the impact properties. As demonstrated in FIG. 1, the propellers die cast from the new alloy of the present invention out-performed the traditional AA 514 alloy, 400 foot pounds to 200 foot pounds.

Subsequently, more than 250,000 propellers have been die cast ranging from small propellers having a shot weight of approximately 3 pounds, medium 50-60 HP propellers having a shot weight of 7 pounds and large V-6 alpha propellers having a shot weight of 11 pounds. None of the 250,000 die cast propellers die cast from the alloy according to the present invention had any soldering problems. This is truly remarkable because the new propeller alloy is very low in iron content and one of ordinary skill in the art would have expected soldering to be a problem.

EXAMPLE 5

Drive shaft housings for a 275 HP, four stroke outboard engine were die cast from an XK 360 alloy having a composition in percent weight of 10.5 to 11.5% silicon, 1.3% maximum iron, 0.15% maximum copper, 0.20-0.30% manganese, 0.55-0.70% magnesium, trace amounts of zinc, nickel, tin, lead and the balance aluminum.

A second lot of a drive shaft housings for a 275 HP, four stroke outboard engine were produced according to the present invention from an alloy having the following composition of percent weight: 8.75-9.75% silicon, 0.20% maximum iron, 0.05-0.07% strontium, 0.15% maximum copper, 0.25-0.35% manganese, 0.35-0.45% magnesium, 0.10% zinc, trace amounts of iron, and balance aluminum. The drive shaft housings were cast on two different 1,600 ton die casting machines at 1,260 degrees Fahrenheit, and had a shot weight of approximately 50 pounds.

The two lots of drive shaft housings were subjected to a "log impact" test where the drive shaft housing is subjected to consecutive hits with an underwater object, simulating an outboard assembly colliding with a log located under water. The drive shaft housings prepared from alloy of the present invention passed the log impact test at 50 mph, whereas drive shaft housings cast from the XK 360 alloy failed at 35 mph.

Squaring the ratio of these two velocities indicates that the alloy of the present invention exhibits more than double the impact energy than the XK360 alloy.

Figure 4:
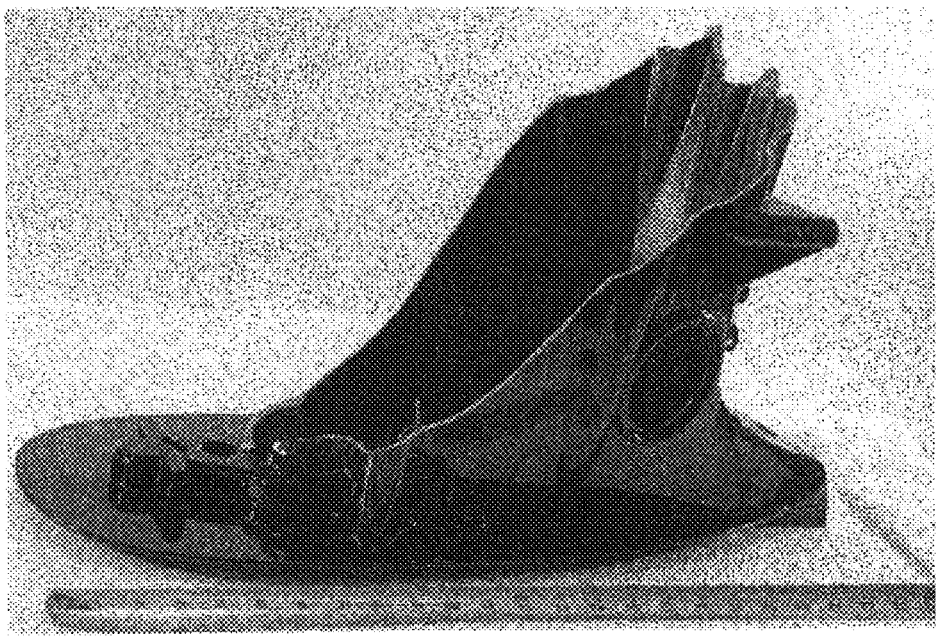
FIG. 4 is a perspective view of a driveshaft housing manufactured from the XK360 alloy that was subjected to a static load until the driveshaft housing failed.
Figure 5:
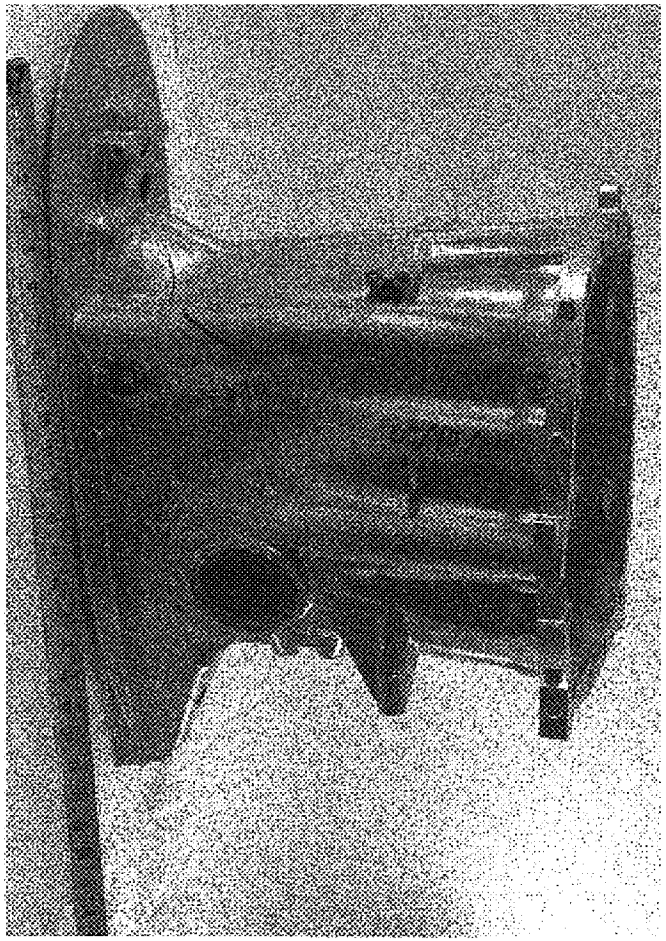
FIG. 5 is a perspective view of a driveshaft housing manufactured from an alloy according to the present invention that was subjected to the same and higher static load as the driveshaft housing of FIG. 4.

The drive shaft housings manufactured from the two lots noted above were further subject to a test where the bottom portion of the drive shaft housing is bolted to a movable base and the top/front section of the drive shaft housing is statically loaded until failure occurs. The results obtained from this experiment demonstrated in FIGS. 4 and 5. The XK360 driveshaft housing (FIG. 4) failed suddenly in a fast propagation mode. As expected, crack initiation started at the front of the driveshaft housing where the stress is highest and progressed (upwardly in the picture) to the back of the driveshaft housing in milliseconds. In contrast, the driveshaft housing manufactured with an alloy according to the present invention (FIG. 5) failed in a slower, more stable manner. A crack first started at the perimeter of the circular hole feature and the crack stopped after growing approximately two inches. Subsequently, a second crack initiated on the front side of the driveshaft housing (similar to the crack initiation of the XK360) and this second crack grew several inches before it stopped. The driveshaft housing manufactured with an alloy according to the present invention (FIG. 5) was able to tolerate twice the static toughness (i.e. area under the load displacement curve) than the XK360 alloy (FIG. 4). Furthermore, after tolerating twice the static toughness, at a load higher than the load that failed the XK360 driveshaft housing, the driveshaft housing manufactured with an alloy according to the present invention (FIG. 5) is, quite unexpectedly, still in one piece. This test has been repeated over twenty times and the results, as described above, are continuously duplicated.

In reviewing the results of the test described, above, it is recognized that the alloy of the present invention tolerates approximately twice static toughness and twice the impact properties as the die cast XK 360 alloy. Accordingly, one of skill in the art will realize that the alloy of the present invention has demonstrated twice the static toughness and twice the impact properties of XK 360, the alloy that has been traditionally used for 20 years for drive shafts.

Approximately 10,000 drive shaft housings were cast with the alloy of the present invention on a 1,600 ton die casting machine at 1,260 degrees Fahrenheit. The approximate surface area where soldering could have occurred was over 1,600 square inches. In spite of the large surface area, and in spite of the alloy's very low iron content, no soldering was experienced in the castings. The dies were run at both hot and cold conditions, and it was found that the alloy of the present invention prefers the hot running condition. However, in both the hot and cold condition, no die soldering was observed.

EXAMPLE 6

Approximately 50-150 propellers were die cast with the following specific alloy formulations, and soldering to the die cast dies was not observed, despite the low iron content: a) 5.96% by weight silicon, 0.19% by weight iron, 0.081% by weight strontium, 0.17% by weight copper, 0.31% by weight manganese, 0.39% by weight magnesium, balance aluminum; b) 6.45% by weight silicon, 0.23% by weight iron, 0.070% by weight strontium, 4.50% by weight copper, 0.46% by weight manganese, 0.27% by weight magnesium, 2.89% by weight zinc, balance aluminum; c) 6.68% by weight silicon, 0.24% by weight iron, 0.054% by weight strontium, 3.10% by weight copper, 0.41% by weight manganese, 0.29% by weight magnesium, balance aluminum; d) 7.23% by weight silicon, 0.20% by weight iron, 0.072% by weight strontium, 0.21% by weight copper, 0.45% by weight manganese, 0.31% by weight magnesium, balance aluminum; e) 7.01% by weight silicon, 0.12% by weight iron, 0.069% by weight strontium, 0.10% by weight copper, 0.33% by weight manganese, 0.61% by weight magnesium, balance aluminum; f) 11.31% by weight silicon, 0.25% by weight iron, silicon, 0.25% by weight iron, 0.096% by weight strontium, 0.20% by weight copper, 0.28% by weight manganese, 0.31% by weight magnesium, balance aluminum; g) 12.21% by weight silicon, 0.24% by weight iron, 0.051% by weight strontium, 3.52% by weight copper, 0.53% by weight manganese, 0.30% by weight magnesium, and the balance aluminum.

EXAMPLE 7

Approximately 100 propellers were die cast with the following hypereutectic AlSi alloy composition according to the present invention: 19.60% by weight silicon, 0.21% by weight iron, 0.062% by weight strontium, 0.19% by weight copper, 0.29% by weight manganese, 0.55% by weight magnesium, balance aluminum. In all of the propellers die cast, soldering to the die casting dies was not observed, despite the low iron content. Unlike the equiaxed primary silicon particles embedded in an unmodified eutectic structure, typical of strontium free, phosphorus refined microstructure, the above noted alloy, when die cast, has a primary silicon in spherical form and the eutectic structure is modified. The strontium affected structure would be expected to have greater impact properties than the strontium free microstructure.

It should be apparent to those skilled in the art that the present invention as described herein contains several features, and that variations to the preferred embodiment disclosed herein may be made which embody only some of the features disclosed herein. Various other combinations, and modifications or alternatives may be also apparent to those skilled in the art. Such various alternatives and other embodiments are contemplated as being within the scope of the following claims which particularly point out and distinctly claim the subject matter regarded as the invention.

What is claimed is:

1. An aluminum silicon die cast alloy consisting essentially of: 7.80-11.5% by weight silicon, 0.05-0.10% by weight strontium, 0.40% by weight maximum iron, 4.5% by weight maximum copper, 0.50% by weight maximum manganese, 0.60% by weight maximum magnesium, 3.0% by weight maximum zinc, and the balance aluminum, wherein the alloy is free from grain refinement by titanium or boron, wherein the alloy avoids soldering to die casting dies, and wherein the alloy is formed by the step of die casting.

2. An aluminum silicon die cast alloy according to claim 1, wherein the alloy has a hypoeutectic aluminum silicon microstructure.

3. An aluminum silicon die cast alloy according to claim 1, wherein the alloy consists essentially of: 8.75-9.75% by weight silicon, 0.05-0.07% by weight strontium, 0.30% by weight maximum iron, 0.20% by weight maximum copper, 0.25-0.35% by weight manganese, 0.20-0.45% by weight magnesium, 0.09% by weight maximum titanium and the balance aluminum.

4. An aluminum silicon die cast alloy according to claim 3 wherein the alloy is die cast to form a marine propeller.

5. An aluminum silicon die cast alloy according to claim 3, wherein the alloy is die cast to form a drive shaft housing for an outboard motor assembly.

6. An aluminum silicon die cast alloy according to claim 3, wherein the alloy is die cast to form a gearcase housing for an outboard motor assembly.

7. An aluminum silicon die cast alloy according to claim 3, wherein the alloy is die cast to form a Gimbel ring for an outboard stern drive motor assembly.

8. An aluminum silicon die cast alloy according to claim 1, wherein the alloy has at least double the static toughness as a die cast XK 360 alloy.

9. An aluminum silicon die cast alloy according to claim 1, wherein the alloy demonstrates double the impact resistance as a die cast XK 360 alloy.

10. An aluminum silicon die cast alloy according to claim 3, wherein the alloy has at least double the static toughness as a die cast XK 360 alloy.

11. An aluminum silicon die cast alloy according to claim 3, wherein the alloy demonstrates double the impact resistance as a die cast XK 360 alloy.

12. An aluminum silicon die cast alloy according to claim 5, wherein the alloy has at least double the static toughness as a die cast XK 360 alloy.

13. An aluminum silicon die cast alloy according to claim 5, wherein the alloy demonstrates double the impact resistance as a die cast XK 360 alloy.

14. An aluminum silicon die cast alloy according to claim 4, wherein the alloy demonstrates double the impact resistance as die cast AA514 alloy.

15. An aluminum silicon die cast alloy according to claim 1, wherein the alloy demonstrates double the impact resistance as die cast AA514 alloy.

16. An aluminum silicon die cast alloy according to claim 3, wherein the alloy demonstrates double the impact resistance as die cast AA514 alloy.

* * * * *

UNITED STATES PATENT AND TRADEMARK OFFICE

CERTIFICATE OF CORRECTION

PATENT NO. : 7,666,353 B2
APPLICATION NO. : 11/042252
DATED : February 23, 2010
INVENTOR(S) : Donahue et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 764 days.

Signed and Sealed this

Seventh Day of December, 2010

David J. Kappos

David J. Kappos
*Director of the United States Patent and Trademark Office*